US006474646B1

(12) United States Patent
Webb

(10) Patent No.: US 6,474,646 B1
(45) Date of Patent: Nov. 5, 2002

(54) METHOD AND APPARATUS FOR PLAYING MULTIPLE HAND CARD GAME

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

(21) Appl. No.: 09/845,332

(22) Filed: May 1, 2001

(51) Int. Cl.[7] ..... A63F 1/00
(52) U.S. Cl. ..... 273/274; 273/292
(58) Field of Search ..... 273/292, 274; 463/13

(56) References Cited

U.S. PATENT DOCUMENTS 5,265,882 A * 11/1993 Malek ..... 273/274
5,294,128 A * 3/1994 Marquez ..... 273/292
5,678,821 A * 10/1997 Hedman ..... 273/274
6,155,568 A * 12/2000 Franklin ..... 273/292
6,237,916 B1 * 5/2001 Webb ..... 273/292

* cited by examiner

*Primary Examiner*—Benjamin H. Layno
*Assistant Examiner*—Vishu K Mendiratta
(74) *Attorney, Agent, or Firm*—Nixon & Vanderhye P.C.

(57) ABSTRACT

In a card game, each player and the dealer are dealt five cards to form two two-card hands and one one-card hand, corresponding to a HIGH hand, a MID hand, and a LOW hand. The player HIGH, MID and LOW hands are compared with the respective dealer hands to determine a game result. In one operating mode, players can make a wager for each of the three hands, and the wagers are paid or taken separately depending on the respective comparison results. Alternatively, players may make a single wager that wins if the player wins at least two out of the three hands. The game also includes provisions for proposition wagers such as a copy wager and/or a pair wager as well as an empty hand or Dragon Hand concept. The three hand game is more exciting than existing multiple hand games and provides a perception of higher payoff frequency.

30 Claims, 2 Drawing Sheets

METHOD AND APPARATUS FOR PLAYING MULTIPLE HAND CARD GAME

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a casino poker game and, more particularly, to a card game providing multiple-hand competition with competition and proposition wagers.

Multiple-hand poker games are currently in play in casinos. An example of such a game is so-called Pai Gow poker, which may also be played in a card room environment. The game was originally based on Chinese Dominoes or Pai Gow, and the common card version may also be known as Asian Poker or Double Hand. Double Hand may be played as a player banked game with the bank moving in rotation or as a house banked game with a fixed banker also being the dealer. Double Hand is usually played with a Joker included in a 53-card deck, with the Joker being used in a straight or in a flush or as an Ace.

At Double Hand, each player makes a wager, then the player and dealer each receive seven cards. Each player forms a five-card poker hand and a two-card poker hand, with the 5-card hand being superior to the two-card hand. In the two-card hand, only Pairs and High cards are of value, whereas in the 5-card hand, all poker hands are possible. The player hands are compared to the dealer hands. A player winning both hands is paid 1 to 1 on the wager. A player winning one hand and losing one hand pushes the wager, and a player losing both hands loses the wager. The house advantage is generated by two means. Firstly, a commission is paid on player winnings; secondly, any copy hand is deemed as won by the house.

There are a number of problems with Double Hand operation. For example, collection of commission is time-consuming and may result in errors. Moreover, setting the dealer hand the house way is complex and error prone for a novice dealer. Hand setting is also complex and intimidating for novice players. There are certain rituals regarding selecting the first player to be dealt to and dealing to absent player positions that slow down the game. Additionally, there is a very high proportion of push decisions, and due to the initially dealt 7-card hands, the game is restricted to six players.

SUMMARY OF THE INVENTION

It would thus be desirable to provide a simplified multiple-hand poker game that improves upon existing games and is desirable to both players and casinos.

In the triple hand poker game according to the present invention, after making one or more wagers, the players and dealer each receive a hand of five cards and create three hands being a two-card HIGH hand, a two-card MID hand, and a one-card LOW hand. In one wagering embodiment, each player places one wager. If the player wins two or three of the hands, then the wager wins. If the player loses two or three of the hands, then the wager is lost. In another wagering embodiment, the player places three equal wagers being one on each of the respective hands.

In each wagering embodiment, the high frequency of push hands in the previous Double Hand game is eliminated. Moreover, there is no commission paid on winnings as the house advantage is within the copy. The copy occurs more frequently in the Double Hand game in the two-card hand than the 5-card hand. In the triple hand game according to the invention, there are two possible two-card copy hands and one much more possible one-card copy hand. Copy rules may be varied to create different house advantages.

Additionally, there are at least two possible proposition wager options. A COPY wager is a wager that at least one copy hand will result between the player and the dealer. Either the payoff increases as the number of copy hands increases, providing different payoffs, or there is a composite payoff. Additionally, a PAIR wager is a wager that the player hand will include at least one pair with a payoff increasing as the total poker hand rank increases, or there is a composite payoff.

In still another feature of the invention, a hand not being played by a player is designated as a Dragon Hand, and a player with a hand may also wager on the Dragon Hand against the dealer hand. Alternatively, the dealer may have as many as three hands that the player can wager against. These additional options are more viable at Triple Hand according to the present invention where hand setting is more fixed than at the previous Double Hand game. Moreover, knowledge of other cards is less relevant at Triple Hand according to the present invention.

In an exemplary embodiment of the invention, in a method of playing a card game, a plurality of cards are dealt to a player and a dealer. The player and dealer each form three hands with the plurality of cards corresponding to a HIGH hand, a MID hand, and a LOW hand. A game result is determined by comparing the player HIGH, MID and LOW hands with the respective dealer hands. In a preferred embodiment, five cards are dealt to each of the player and the dealer, and the hands include a two-card HIGH hand, a two-card MID hand, and a one-card LOW hand. The manner of forming the dealer hands can be practiced according to predetermined hand-forming rules. For example, with a hand of two pair, the HIGH hand is a HIGH PAIR, the MID hand is a LOW PAIR, and the LOW hand is an odd card; with a hand of one pair, the HIGH hand is a PAIR, the MID hand contains a high card and a low card, and the LOW hand is an odd card; and with a hand of no pair, the HIGH hand is a highest card and a lowest card, the MID hand is a second highest card and a second lowest card, and the LOW hand is a third highest card. In an alternative "no pair" hand-forming rule, the HIGH hand is a highest card and a second lowest card, the MID hand is a second highest card and a lowest card, and the LOW hand is a third highest card. The HIGH hand typically must be better than the MID hand, and the MID hand typically must be better than the LOW hand.

In one arrangement, only pairs and high cards have rank value. Alternatively, a two-card straight flush, a two-card straight, a two-card flush, pairs and high cards have rank value.

Prior to dealing the cards, a competition wager may be received from the player on the game result. By placing the competition wager, the player is wagering that at least two of the player HIGH, MID and LOW hands will beat the dealer's respective hands according to the comparison of the respective hands. In this context, the method may including paying a payout of 1 to 1 if at least two of the player HIGH, MID and LOW hands beat the dealer's respective hands. In an alternative operating mode, three separate wagers are received from the player, including a HIGH hand wager, a MID hand wager, and a LOW hand wager, wherein the method includes paying a payout for each player hand that beats the dealer's respective hands. Each of these payouts may also be 1 to 1. With the three separate wagers, preferably, the HIGH hand wager, the MID hand wager, and the LOW hand wager are equal amounts.

The player may also place a proposition wager for a peripheral event during the card game. In one operating mode, the peripheral event includes at least one occurrence of a copy hand between the player and the dealer. A variable payout may be paid based on a number of copy hands between the player and the dealer. The peripheral event may additionally or alternatively include at least one occurrence of a pair in the player's hands. A similar variable payout may be paid based on a number of pairs in the player's hands.

In still another feature of the invention, the player may place a side wager on at least one Dragon Hand. An additional plurality of cards are dealt and at least one Dragon Hand is correspondingly formed into three hands with the plurality of cards corresponding to a HIGH hand, a MID hand, and a LOW hand. A Dragon Hand game result is determined by comparing the at least one Dragon Hand HIGH, MID and LOW hands with either the respective dealer hands or the respective player hands. The side wager is then resolved according to the Dragon Hand game result.

Copy hands between the player and dealer may be resolved as a player loss. Multiple copy hands between the player and the dealer may alternatively be resolved as a player win of all copy hands.

In still another operating mode, if the player five cards form a poker rank such as a flush or better, the game is resolved by declaring the player as an automatic winner of all three hands.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

In the following detailed description, a method and apparatus according to the present invention will be described in conjunction with its application to a casino environment, thus incorporating wagers, payouts, etc. Those of ordinary skill in the art will readily comprehend alternative applications of the present invention outside a casino environment, and the invention is not meant to be limited to the described application. For example, the game may be embodied in a video game that is played for entertainment purposes against a computer or the like. Alternatively, players may play the game without wagers in a head-to-head format with one player acting as a dealer, with the players simply keeping track of wins and losses.

Figure 1:
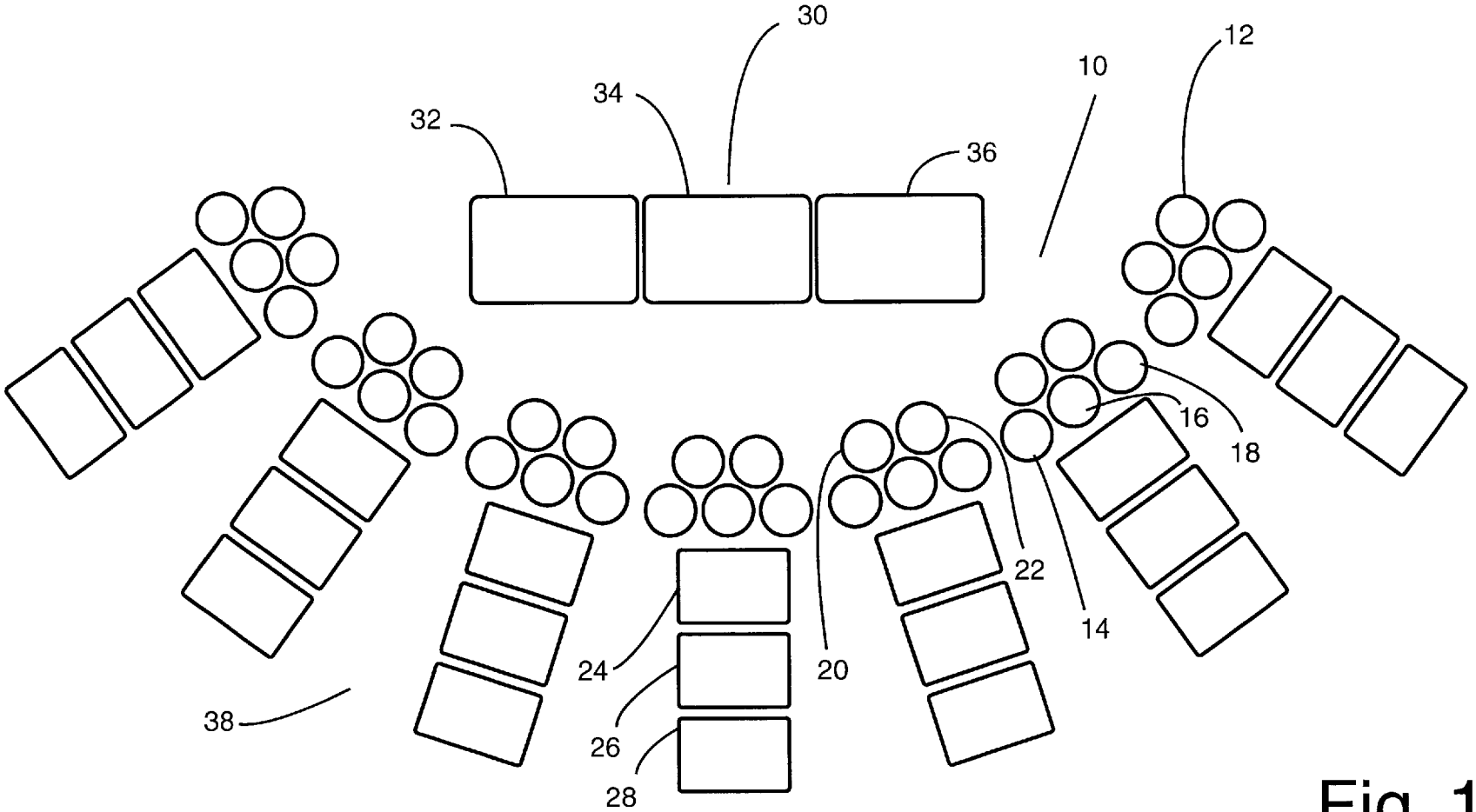
FIG. 1 is a plan view of a table arrangement according to the present invention.

With reference to FIG. 1, Triple Hand poker according to the present invention may be played on a Blackjack style or Poker style table with a dealer also acting as a banker in the house banked version. Typically, a standard 52-card deck of playing cards is used. The playing surface or table layout 10 includes a playing area 12 for each player, each with three primary wager areas for HIGH 14, MID 16 and LOW 18. The playing area 12 also includes two secondary wager areas for a COPY wager 20 and a PAIR wager 22. Three card hand areas are provided for each player for a HIGH hand 24, MID hand 26, and LOW hand 28. A dealer area 30 similarly contains three card hand areas for a HIGH hand 32, MID hand 34 and LOW hand 36. Rules and payoffs are displayed at 38.

In a preferred operating mode, to play the game, each player places three equal compulsory wagers at wager areas 14, 16 and 18. Each player may also place optional wagers at either or both secondary wager areas 20, 22. Each player and the dealer receive five cards in rotation. In this context, by dealing only five cards to each player and the dealer, up to seven players may play the game at one time. Each player and the dealer then create three hands with the five cards being two hands of two cards each and one hand of one card. The players' two-card HIGH hands are placed at hand area 24, the two-card MID hands are placed at hand area 26, and the one-card LOW hands are placed at hand area 28. After all players have acted, the dealer cards are exposed and set into three similar hands of two cards, two cards and one card and placed respectively at card hand areas 32, 34 and 36. In the operating embodiment, the HIGH hand must be better than the MID hand, and the MID hand must be better than the LOW hand for all players and the dealer.

The exact method of dealer hand set depends on the version in operation, which can be set according to casino-specific rules. For example, in one playing embodiment, only pairs and high cards have rank value. In this embodiment, a preferred standard house way of setting hands is provided according to predetermined hand-forming rules as follows:

(1) with a hand of two pair, the HIGH hand is a high pair, the MID hand is a low pair, and the LOW hand is an odd card;

(2) with a hand of one pair, the HIGH hand is a pair, the MID hand contains a high card and a low card, and the LOW hand is an odd card; and (3) with a hand of no pair, the HIGH hand is a highest card and a lowest card, the MID hand is a second highest card and a second lowest card, and the LOW hand is a third highest card. In an alternative "no pair" forming rule, (3) the HIGH hand is a highest card and a second lowest card, the MID hand is a second highest card and a lowest card, and the LOW hand is a third highest card. This provides a simple fixed house way capable of being implemented by any dealer. Additionally, the player perception is that the house is restricted in playing strategy.

In another playing embodiment, a two-card straight flush, a two-card straight and a two-card flush also have rank value. With these additional hands, the manner of setting the dealer hands can be varied significantly according to house rules. In either playing mode, a rule may be established that pairs in the dealer hands are never split.

The dealer then evaluates each player hand in rotation. The respective dealer and player HIGH hands 24, 32 are compared, the MID hands 26, 34 are compared, and the LOW hands 28, 36 are compared. Each wager at wager areas 14, 16 and 18 independently either wins a fixed payout (such as 1 to 1) or loses based on the specific comparison. The comparison is made based on Poker combinations and rules inasmuch as such rules are applicable with hands of two cards, two cards and one card, respectively. The payout may be altered either in the player's favor or the casino's favor, and the invention is not meant to be limited to the described example. In an alternative playing mode, the three primary wager areas 14, 16 and 18 are replaced with a single wager area, wherein if the player wins two or three of the hands, then the wager wins a payout of, for example, 1 to 1. If the player loses two or three of the hands, then the wager is lost.

In the event of an exact same hand, for example, a hand having an equal poker rank, this specific hand is regarded as a copy, and house rules apply accordingly. Preferably, the house wins a copy hand wager. The rules for resolving copy hands can be altered, however, to modify the casino house advantage. For example, although the house may win one copy, the player may win two- or three-copy hands. Odds above 1 to 1 could apply in this instance. Another example is that the house wins a copy on an exact nominated hand (e.g., LOW) but the player wins a copy on either of the other exact nominated hands (in this case, HIGH and MID).

If a player places one or more secondary proposition wagers, these wagers are paid appropriately during the dealer's evaluation of each player's hands. A COPY proposition wager at secondary wager area 20 wins an appropriate payoff upon the occurrence of a copy hand between the player and the dealer. The payoff may be increased as the number of copy hands increases, providing different payoffs, or there may be a composite payoff. Similar rules apply with respect to the PAIR proposition wager at wager area 22. The PAIR proposition wager wins a payoff upon the occurrence of a pair in one of the two two-card player hands. The payoff may increase as the total poker rank increases, or the wager may be awarded a composite payoff. Dealer hand pairs etc. may also be incorporated into the PAIR proposition wager.

In yet another operating mode, there are additional competition wagers that may be placed by the players. A hand not being played by a player is designated as an empty hand or Dragon Hand, and a player may also wager on the Dragon Hand against the dealer hand. With fewer cards used, there is the possibility of a minimum of two Dragon Hands. Alternatively, the dealer may have as many as three hands that the players can wager against. Thus, a first competition wager option is that all players may bet against the dealer hand on any hand that does not have a designated player. A second competition wager option is that the player hand is bet against any hand that does not have a designated player, with these hands deemed to be dealer hands for this purpose.

As would be apparent to those skilled in the relevant art, the invention can be embodied in a wide variety and forms of media such as, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
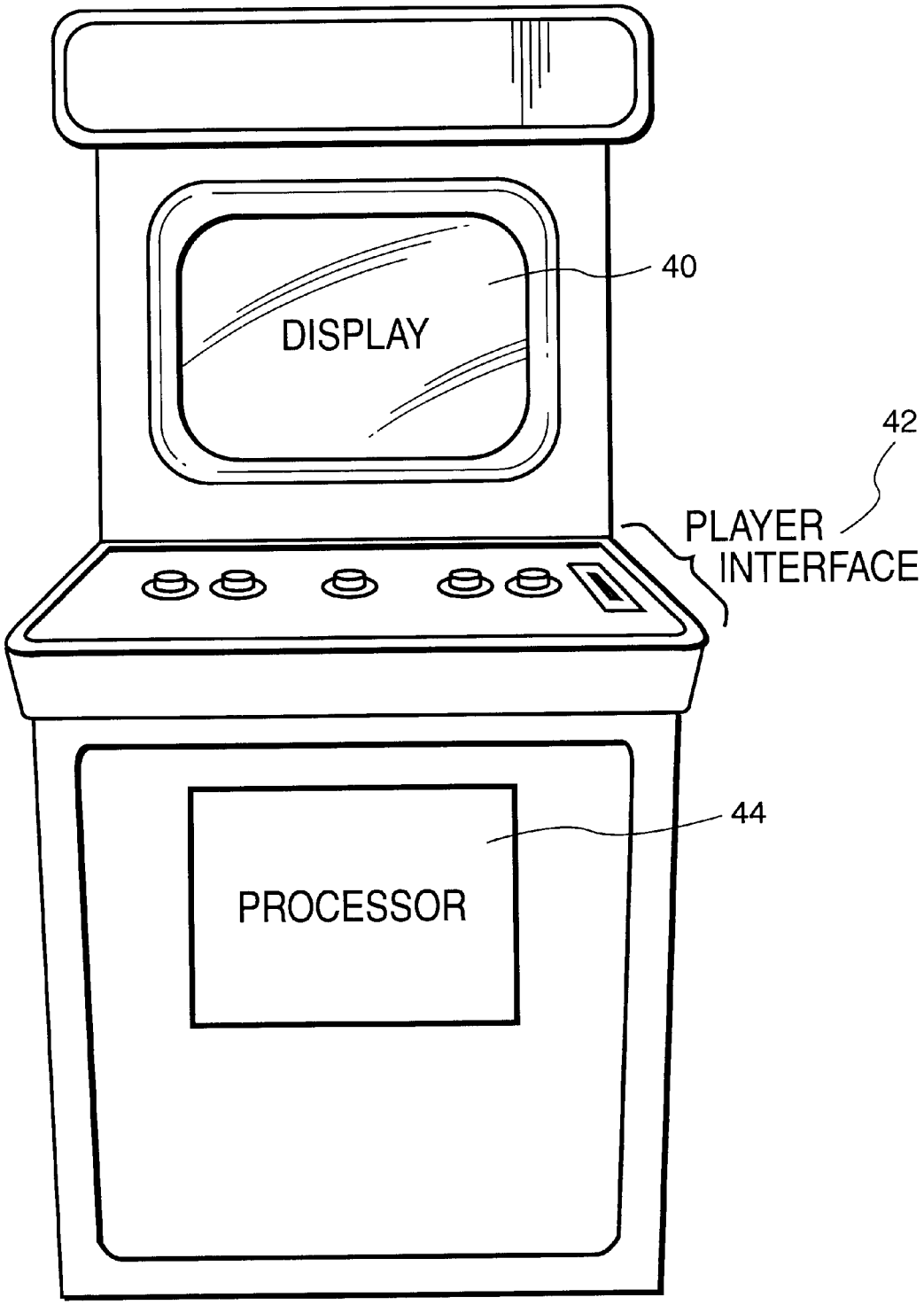
FIG. 2 is a schematic diagram illustrating the structure effecting game play according to the apparatus of the present invention.

In this context, referring to FIG. 2, a block diagram is illustrated showing the components of an apparatus configured for playing the game according to the invention. The apparatus includes a display 40, a player interface 42, and circuitry 44 for effecting game play and including structure for receiving wagers, dealing hands and resolving wagers according to the game rules. That is, a processing circuit 44 is programmed to effect game play according to the rules of the game, enabling players to selectively form HIGH, MID and LOW hands and automatically forming dealer hands according to hand-forming rules. The system resolves competition wagers based on a comparison of the player HIGH, MID and LOW hands with the respective dealer hands, and resolves proposition wagers according to game rules.

The Triple Hand game according to the present invention enables a number of advantages not previously recognized in existing games. The incidence of pushes, which occurs often in conventional Double Hand poker, has been eliminated. The calculation and collection of commission has been eliminated, thereby also eliminating the associated errors and collection problems. The house way may be set to eliminate any variation and subsequent potential dealer error. An alternative house way allowing variation from standard set in certain situations offers only minimal opportunity for strategy variation and subsequent potential dealer error. The simplicity of hand setting also enables ease of player and dealer acceptance.

The wager embodiment of three wagers is attractive to players. This creates more wagers on the table and a higher payoff frequency, although one of the payoff situations is an overall player loss. The proposition wagers of COPY and PAIR both have sufficient frequency to appear to be accessible and allow rewarding odds payoffs. The extra wager options on additional hands is beneficial where there is a low player table occupancy.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a card game with conventional playing cards, the method comprising:

(a) dealing five playing cards each to a player and a dealer;

(b) the player and the dealer each forming three hands with the five playing cards corresponding to two-card a HIGH hand, a two-card MID hand, and a one-card LOW hand; and (c) determining a game result by comparing the player HIGH, MID and LOW hands with the respective dealer hands.

2. A method according to claim 1, wherein for the dealer only, step (b) is practiced according to predetermined hand-forming rules.

3. A method according to claim 2, wherein the predetermined hand-forming rules comprise:

(1) with a hand of two pair, the HIGH hand is a high pair, the MID hand is a low pair, and the LOW hand is an odd card;

(2) with a hand of one pair, the HIGH hand is a pair, the MID hand contains a high card and a low card, and the LOW hand is an odd card; and (3) with a hand of no pair, the HIGH hand is a highest card and a lowest card, the MID hand is a second highest card and a second lowest card, and the LOW hand is a third highest card.

4. A method according to claim 2, wherein the predetermined hand-forming rules comprise:

(1) with a hand of two pair, the HIGH hand is a high pair, the MID hand is a low pair, and the LOW hand is an odd card;

(2) with a hand of one pair, the HIGH hand is a pair, the MID hand contains a high card and a low card, and the LOW hand is an odd card; and (3) with a hand of no pair, the HIGH hand is a highest card and a second lowest card, the MID hand is a second highest card and a lowest card, and the LOW hand is a third highest card.

5. A method according to claim 2, wherein the HIGH hand must be better than the MID hand, and the MID hand must be better than the LOW hand.

6. A method according to claim 1, wherein only pairs and high cards have rank value.

7. A method according to claim 1, wherein a two-card straight flush, a two-card straight, a two-card flush, pairs and high cards have rank value.

8. A method according to claim 1, further comprising, prior to step (a), the step of receiving a competition wager from the player on the game result.

9. A method according to claim 8, wherein the wager receiving step comprises receiving the competition wager from the player that at least two of the player HIGH, MID and LOW hands will beat the dealer's respective hands according to the comparison in step (c).

10. A method according to claim 8, further comprising, after step (c), the step of paying a payout of 1 to 1 if at least two of the player HIGH, MID and LOW hands beat the dealer's respective hands according to the comparison in step (c).

11. A method according to claim 8, wherein the wager receiving step comprises receiving a HIGH hand wager, a MID hand wager, and a LOW hand wager, and further comprising, after step (c), the step of paying a payout for each player hand that beats the dealer's respective hands according to the comparison in step (c).

12. A method according to claim 11, wherein the payout is 1 to 1.

13. A method according to claim 11, wherein the HIGH hand wager, the MID hand wager, and the LOW hand wager are equal amounts.

14. A method according to claim 1, further comprising, prior to step (a), the step of receiving a proposition wager for a peripheral event during the card game.

15. A method according to claim 14, wherein the peripheral event comprises at least one occurrence of a copy hand between the player and the dealer.

16. A method according to claim 15, further comprising paying a variable payout based on a number of copy hands between the player and the dealer.

17. A method according to claim 14, wherein the peripheral event comprises at least one occurrence of a pair in the player's hands.

18. A method according to claim 17, further comprising paying a variable payout based on a number of pairs in the player's hands.

19. A method of playing a card game with conventional playing cards, the method comprising:

(a) dealing a plurality of cards to a player and a dealer;

(b) the player and the dealer each forming three hands with the plurality of cards corresponding to a HIGH hand, a MID hand, and a LOW hand;

(c) determining a game result by comparing the player HIGH, MID and LOW hands with the respective dealer hands; and prior to step (a), (d) receiving a side wager on at least one dragon hand and substantially concurrently with step (a), the steps of:

dealing a plurality of cards and correspondingly forming each of the at least one dragon hand into three hands with the plurality of cards corresponding to a HIGH hand, a MID hand, and a LOW hand;

determining a dragon hand game result by comparing the at least one dragon hand HIGH, MID and LOW hands with either the respective dealer hands or the respective player hands; and resolving the side wager according to the dragon hand game result.

20. A method according to claim 1, wherein step (c) is practiced by resolving copy hands between the player and the dealer as a player loss.

21. A method according to claim 1, wherein step (c) is practiced by resolving multiple copy hands between the player and the dealer as a player win of all copy hands.

22. A method according to claim 1, wherein if the player five cards form a poker rank of a flush or better, step (c) is practiced by declaring the player as an automatic winner of all three hands.

23. An apparatus for playing a card game with conventional playing cards, the apparatus comprising:

means for dealing five playing cards each to a player and a dealer;

means for forming the player cards and the dealer cards each into three hands with the five playing cards corresponding to a two-card HIGH hand, a two-card MID hand, and a one-card LOW hand; and means for determining a game result by comparing the player HIGH, MID and LOW hands with the respective dealer hands.

24. A method of playing a card game with conventional playing cards comprising:

(a) enabling a player to place at least one wager on a game result;

(b) dealing five playing cards each to the player and a dealer;

(c) the player and the dealer each forming three hands with the five cards corresponding to a two-card HIGH hand, a two-card MID hand, and a one-card LOW hand;

(d) determining the game result by comparing the player HIGH, MID and LOW hands with the respective dealer hands; and (e) resolving the at least one wager according to the comparison in step (d).

25. A method according to claim 24, wherein the HIGH hand must be better than the MID hand, and the MID hand must be better than the LOW hand.

26. A method according to claim 24, wherein step (a) is practiced by enabling the player to place a proposition wager for a peripheral event during the card game.

27. A method according to claim 26, wherein the peripheral event comprises at least one occurrence of a copy hand between the player and the dealer.

28. A method according to claim 27, further comprising paying a variable payout based on a number of copy hands between the player and the dealer.

29. A method according to claim 26, wherein the peripheral event comprises at least one occurrence of a pair in the player's hands.

30. A method according to claim 29, further comprising paying a variable payout based on a number of pairs in the player's hands.

* * * * *